US005603630A

United States Patent [19]

Villain

[11] Patent Number: 5,603,630

[45] Date of Patent: Feb. 18, 1997

[54] ADAPTOR SYSTEM BETWEEN AN ANTENNA PLUG AND A RADIOTELEPHONE SOCKET

[75] Inventor: Jean-Christophe Villain, Ermont, France

[73] Assignee: Alcatel Radiotelephone, Paris, France

[21] Appl. No.: 558,976

[22] Filed: Nov. 13, 1995

Related U.S. Application Data

[63] Continuation of Ser. No. 311,899, Sep. 26, 1994, abandoned, which is a continuation of Ser. No. 94,429, Jul. 21, 1993, abandoned.

[30] Foreign Application Priority Data

Jul. 24, 1992 [FR] France ..... 92 09171

[51] Int. Cl.[6] ..... H01R 13/627

[52] U.S. Cl. ..... 439/347; 439/352

[58] Field of Search ..... 439/347, 350, 439/358, 372, 345, 305, 352, 916

[56] References Cited

U.S. PATENT DOCUMENTS

| | | | |
|---|---|---|---|
| 2,502,303 | 3/1950 | Arson et al. | 439/347 |
| 3,046,513 | 7/1962 | Crowley | 439/347 |
| 3,885,851 | 5/1975 | Bennett | 439/352 |
| 4,047,779 | 9/1977 | Klancnik | 349/304 |
| 4,368,940 | 1/1983 | Sugiura | 439/916 |
| 4,857,008 | 8/1989 | Kee et al. | 439/352 |
| 5,015,194 | 5/1991 | Seas | 439/916 |
| 5,061,940 | 10/1991 | Blaese | 439/916 |
| 5,158,483 | 10/1992 | Fishman et al. | 439/916 |

FOREIGN PATENT DOCUMENTS

| | | |
|---|---|---|
| 2544552 | 10/1984 | France . |
| 2584871 | 1/1987 | France . |
| 0443172A1 | 12/1990 | Germany . |
| 9105159 U | 9/1991 | Germany . |

*Primary Examiner*—Hien Vu

*Attorney, Agent, or Firm*—Sughrue, Mion, Zinn, Macpeak & Seas

[57] ABSTRACT

A radiotelephone has a housing for receiving an adaptor member for adapting an antenna plug to a socket. The adaptor member has an electrical connection and mechanical coupling end designed to cooperate with the antenna plug and an at least electrical connection arrangement adapted to cooperate with the socket. The socket comes into electrical contact with the connection arrangement purely by axial insertion of the adaptor member into the housing. The adaptor member is held in the housing by a manually operable holding device to provide an electrical connection between the antenna plug and the socket. The system may be used to connect any commercially available antenna to a specific radiotelephone and is compatible with a large number of antenna attachment/detachment maneuvers.

9 Claims, 2 Drawing Sheets

ADAPTOR SYSTEM BETWEEN AN ANTENNA PLUG AND A RADIOTELEPHONE SOCKET

This is a continuation of application Ser. No. 08/311,899 filed Sep. 26, 1994, now abandoned, which is a continuation of Ser. No. 08/094,429 filed Jul. 21, 1993, now abandoned.

BACKGROUND OF THE INVENTION

1. Field of the Invention

The invention concerns adaptor systems between an antenna and a radio-frequency signal transmitter and/or receiver unit. The present invention is more specifically concerned with an adaptor system for connecting any antenna to a unit of this kind. This is a radiotelephone, for example, and one application of the present invention is to portable radiotelephones.

2. Description of the Prior Art

A portable radiotelephone is a compact unit to which an antenna for transmitting and receiving radio-frequency signals is connected. The antenna has at one end a plug cooperating with a complementary socket fixed to the unit. The plug and the socket make an electrical contact and secure the antenna mechanically to the unit and can be separated manually to remove the antenna to facilitate transporting the unit and the antenna when not in use.

A radiotelephone is designed to receive a particular type of antenna plug which means that the user is obliged to choose an antenna with a plug compatible with the socket on the radiotelephone.

Various standards cover such plugs and sockets for signal frequencies in the order of 900 MHz and SMA type connectors are usually employed. An SMA type connector comprises a female socket having a screwthread providing the ground connection and an internal conductor forming the core and a male plug comprising a nut adapted to cooperate with the aforementioned screwthread and a core. The male plug is fitted to the end of an antenna and it cooperates with the socket by screwing the nut onto the socket screwthread.

The major drawback of this type of connector is that it is not suitable for a large number of antenna maneuvers and the plug and the socket wear rapidly, leading to a deterioration in the quality of microwave transmission. Screwing one member onto the other gives rise to rubbing contact which causes the aforementioned wear. This rubbing contact occurs not only at the ground contact but also at the core and its consequence is wearing away of these contacts.

For this reason manufacturers have developed connectors which do not require one member to be screwed on to the other. One connector commonly known as a "subclic" connector is compatible with a large number of maneuvers and exploits the elasticity of a ring which is part of the antenna plug to fasten the plug to a complementary socket. The main drawback of this type of connector is its high cost and the fact that it is not in widespread use.

A major drawback of existing radiotelephones is that the user does not have a free choice from the range of commercially available antennas as the antenna must necessarily have a plug compatible with the socket on the user's radiotelephone.

An object of the present invention is to overcome these drawbacks.

A more specific first object of the invention is to provide an adaptor system between a radio-frequency signal transmitter-receiver unit and an antenna enabling the user to fit any commercially available antenna to the unit.

A second object of the invention is to provide a system of this kind allowing a large number of maneuvers to attach the antenna to the unit and detach it therefrom.

These objects and others that will emerge later are achieved by a system as defined in the next following paragraph.

SUMMARY OF THE INVENTION

The invention consists in an adaptor system for use between an antenna plug and a socket of a unit for sending and/or receiving radio-frequency signals comprising a housing adapted to receive an adaptor member for adapting said antenna plug to said socket, said adaptor member comprising an electrical connection and mechanical coupling end adapted to cooperate with said antenna plug and at least electrical connection means adapted to cooperate with said socket which is contained within said housing and comes into electrical contact with said connection means purely by axial insertion of said adaptor member into said housing, said adaptor member being held in said housing by manually operable holding means to provide an electrical connection between said antenna plug and said socket when said antenna plug cooperates with said connection end.

With this system any antenna can be fitted to a given unit. The antenna may be attached to and detached from the unit a large number of times because the electrical contact between the socket and the connection means is effected by axial insertion only of the adaptor member into the housing provided in the unit. There is therefore no rotation required to connect the antenna to the unit electrically and mechanically.

The connection means of the adaptor member is preferably an axial connection means which enters the socket axially and the electrical connection end of the adaptor member is preferably a screw terminal cooperating with the antenna plug so that activation of the holding means enables simultaneous axial extraction of the antenna and the adaptor member.

In one advantageous embodiment the connection means and the socket constitute an MCX type connector.

The antenna plug and the connection end preferably constitute an SMA type connector. This type of connector is that most often employed to connect an antenna to a unit and so the user has a wide choice of antenna types.

The manually operable holding means is advantageously a snap-fastener mechanism locking the adaptor member in the housing. This facilitates attaching the antenna to the unit and detaching it therefrom.

In one preferred application the unit is a portable radiotelephone.

The invention also consists in an adaptor member and a unit compatible with the adaptor system as defined above.

Other features and advantages of the invention will emerge from the following description of one preferred embodiment given by way of non-limiting illustrative example only with reference to the appended drawings.

DETAILED DESCRIPTION OF THE INVENTION

Figure 1:
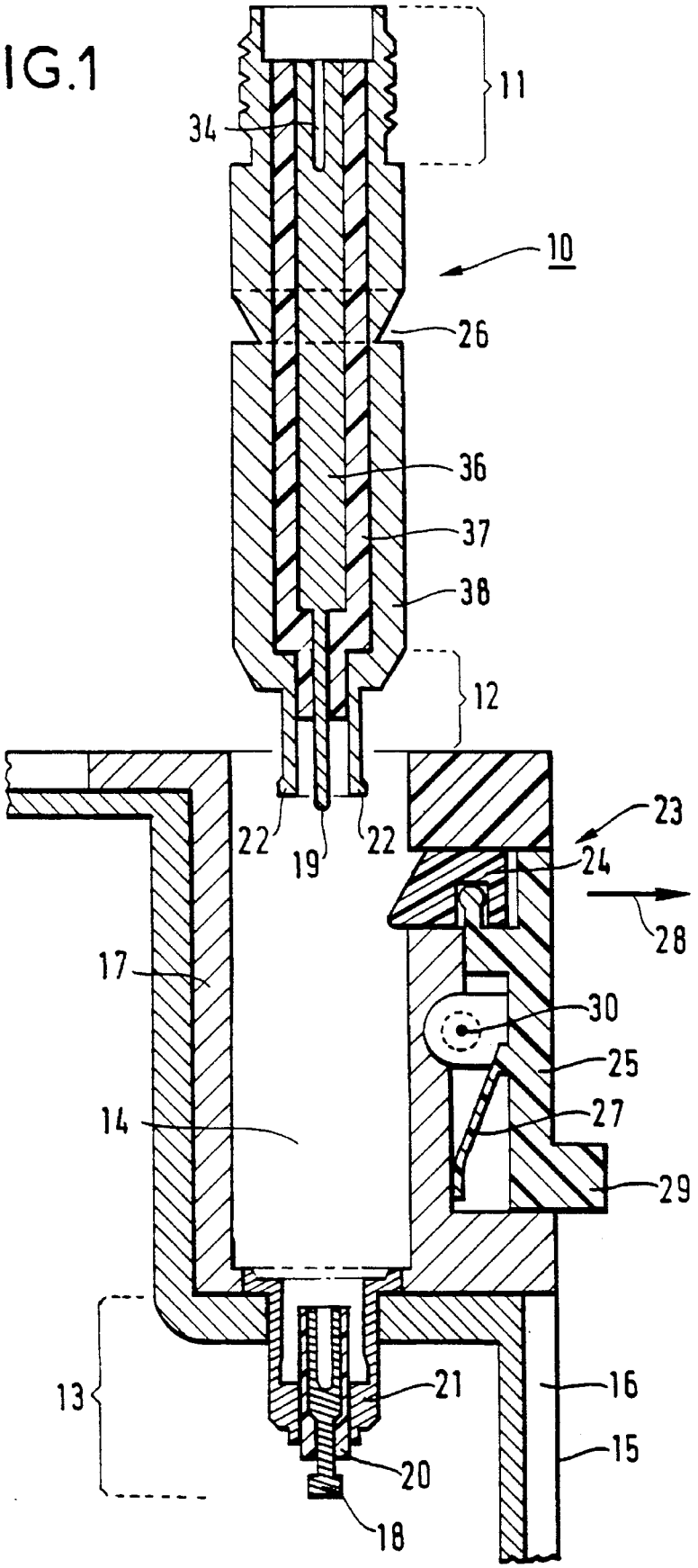
FIG. 1 is an exploded view in cross-section of one embodiment of system in accordance with the invention.
Figure 2:
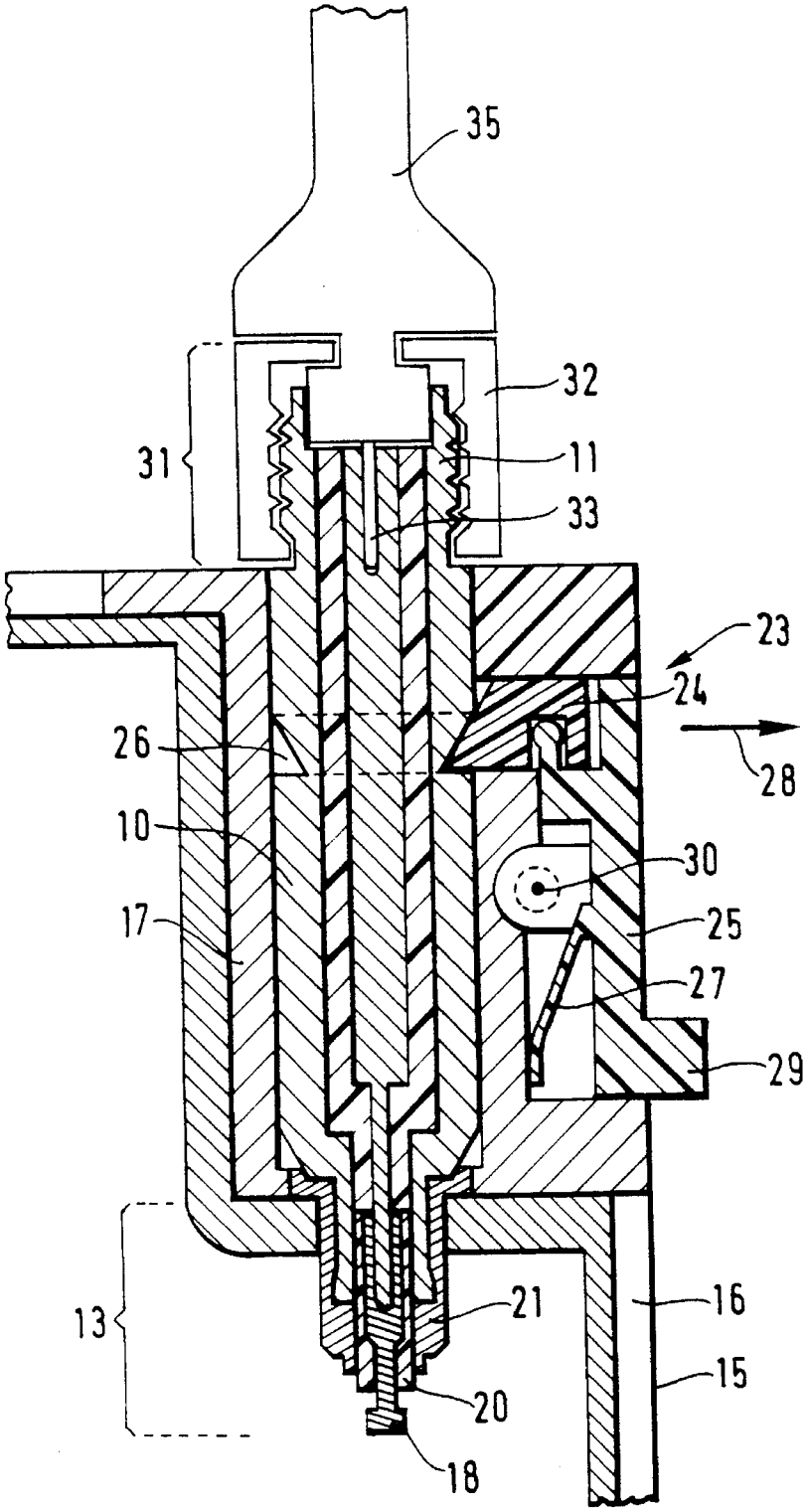
FIG. 2 is a view in cross-section of the components from FIG. 1 when assembled together, an antenna being fixed to the connection end of the adaptor member.

FIGS. 1 and 2 show a preferred embodiment of system in accordance with the invention in cross-section.

This system in accordance with the invention is adapted to allow any type of antenna to be plugged into a unit for sending and/or receiving radio-frequency signals. It comprises an adaptor member 10 having an electrical connection and mechanical coupling end 11 adapted to cooperate with the plug of an antenna shown in FIG. 2. The adaptor member 10 also comprises electrical connection means 12 adapted to cooperate with a complementary socket 13 at the bottom of a housing 14 in the unit 15. One half-shell 16 of the unit is shown and is made from a plastics material, for example.

The housing 14 is cylindrical, for example, and has metal interior walls 17 cooperating electrically and mechanically with the socket 13 which has a metal central female part 18 adapted to come into electrical contact with a core 19 of the connection means 12 of the adaptor member 10, the central part 18 being insulated by an insulator 20 from a ground conductor 21 adapted to come into electrical contact with metal teeth 22 of the means 12. The teeth 22 have some elasticity to retain the adaptor member 10 in the housing 14 when the member 10 is inserted in the housing 14. As will emerge later, this retention is mainly intended to secure optimum electrical contact between the member 10 and the socket 13.

Electrical contact between the member 10 and the socket 13 is achieved entirely by axial insertion of the adaptor member 10 into the housing 14, i.e. no rotation is required to make this electrical contact. This allows a large number of maneuvers since the wear of the parts is very much less than when rotation is required to make electrical and mechanical contact.

The adaptor member 10 is held in the housing 14 by manually operated holding means 23 which provide an electrical connection between the antenna plug 31 (FIG. 2) and the socket 13 when said antenna plug 31 cooperates with the connection end.

In this example the holding means comprise a bevelled latching member 24 enabling the member 10 to be inserted into the housing 14 without operating a lever 25. As shown in FIG. 2, the latching member cooperates with an integral circular groove 26 in the adaptor member 10. This grove is static, in the sense that it has no moving parts. A leaf spring 27 attached to the lever 25 urges the latching member 24 into the position shown. The latching member moves in the direction 28 when the user depresses the lower part 29 of the lever 25 or inserts the connection member 10 into the housing 14. The lever 25 rotates about an axis 30.

If the manually operable holding means comprise a snap-fastener mechanism for locking the adaptor member into the housing on the unit, as shown here, the maneuvers to attach and detach the antenna fitted with the adaptor member 10 are extremely simple.

The connection means 12 and the socket 13 advantageously constitute an MCX type connector. This type of connector is well known in the art of connecting electrical cables and allows a high number of maneuvers (in excess of 4,000 maneuvers).

As shown in FIG. 2, the electrical connection and mechanical coupling end 11 is adapted to cooperate with the plug 31 of an antenna 35. The embodiment shown constitutes an SMA type connector and the antenna plug therefore comprises a nut 32 which is screwed on to the screwthread at the connection end 11 of the adaptor member 10. This type of connector, although the most widely used for radiotelephone antennas, is not compatible with a large number of maneuvers.

It is beneficial to employ axial type connection means on the adaptor member which enters the socket axially and a screw-type electrical connection end which cooperates with the antenna socket so that operation of the holding means enables simultaneous extraction of the antenna and the adaptor member in the axial direction.

The adaptor member 10 may naturally comprise other types of connection end suited to other types of antenna plug. The connection end may be of the "subclic" type, for example, or of the quarter-turn type, etc. Likewise, the socket and the connection means 12 may be of some other type, the essential requirement being that electrical contact between the member 10 and the socket 13 is established within the housing 14 merely by inserting the member 10 into the housing. Metal blades disposed on either side of the housing 14 may be used, for example, in electrical contact with conductive tracks on the adaptor member 10. Note, however, that the electrical connections must be of good quality because the electrical signals are at high frequencies.

The core 33 of the antenna plug 31 (FIG. 2) enters a bore 34 (FIG. 1) in the metal core 36 connected to the metal core 19 of the connection means 12. The adaptor member 10 comprises the metal core 36 covered with an insulator 37 in turn surrounded by a metal grounding body 38 constituting the exterior of the member. The overall length of this member is very short, in the order of 15 mm.

When the various component parts of the system are assembled together electrical continuity is achieved between the parts 18 and 21 and the core and the ground of the antenna through the intermediary of the adaptor member.

Confining the adaptor member 10 in a housing and holding it in this housing makes it possible to dispense with conventional holding means using screw mechanisms.

The present invention applies to any type of unit for sending and/or receiving radio-frequency signals, especially portable radiotelephones. It enables any existing antenna to be attached to a given unit in a way compatible with a large number of maneuvers. Application of the invention to portable radiotelephones is beneficial in that their antenna is frequently removed to facilitate transport when not in use.

There is claimed:

1. An adaptor system for releasably coupling an antenna (35), having an antenna plug (31), to a portable radio transmitter/receiver unit (15) enclosed in a shell (16) and having an antenna socket (13), said system comprising:

an axially extending adaptor member (10) having, at a first end thereof, a first electrical connector (12), and, at an opposite second end thereof, a second electrical connector and mechanical coupler assembly (11) for receiving said antenna plug (31);

in said shell (16), a hollow housing (14) for receiving, through an open first end thereof, said adaptor member (10) axially inserted in said hollow housing, said hollow housing (14) having an opposite closed second end containing said antenna socket (13) into which said first electrical connector (12) is plugged; and also in said hollow housing (14), holding means (23), cooperating with a complementary part of said adaptor member (10), for automatically locking the fully inserted adaptor member (10), said holding means (23) comprising manually operated releasing means (24, 25, 27) operable from an exterior side of said housing (14), for releasing the locked adaptor member (10).

2. The adaptor system according to claim 1, wherein said second electrical connector and mechanical coupler assembly (11) is a screw terminal cooperating with said antenna plug so that operation of said holding mean enables simultaneous axial extraction of said antenna and said adaptor member.

3. The adaptor system according to claim 1, wherein said first electrical connector (12) of said adaptor member (10) and said socket (13) constitute an MCX type connector.

4. The adaptor system according to claim 1, wherein said antenna plug (31) and said second electrical connector and mechanical coupler assembly (11) of said adaptor member constitute an SMA type connector.

5. The adaptor system according to claim 1, wherein said holding means comprises a snap-fastener mechanism locking said adaptor member in said housing.

6. The adaptor system according to claim 1, wherein said portable transmitter/receiver unit is a portable radiotelephone.

7. An elongated adaptor member (10) receiving an antenna plug and adapted to be received in a socket of a portable unit for sending or receiving radio-frequency signals, said portable unit comprising a housing containing said socket and arranged for receiving said adaptor member, said adaptor member (10) comprising:

on a first end thereof an electrical and mechanical coupling means (11), including external threads, receiving said antenna plug;

electrical connection means, on an opposite end of said adaptor member (10), for being received in said socket and for coming into electrical contact with said socket purely by axial insertion of said adaptor member (10) into said housing; and static locking means (26), integral with said adaptor member (10) and located approximately at a midpoint of said elongated adaptor member (10), cooperating with manually. operable holding means (23) mounted exclusively on said housing for releasably retaining said adaptor member (10) in said housing and in contact with said socket to provide an electrical path between said antenna plug and said socket when said antenna plug is received in said electrical and mechanical coupling means, said holding means comprising manually operated releasing means (24, 25, 27), operable from an exterior side of said housing (14), for easily and rapidly releasing the adaptor member (10) from said housing.

8. The adaptor member as defined in claim 7, wherein said static locking means (26) is a groove in said adaptor member (10).

9. A portable unit for sending or receiving radio-frequency signals and compatible with use of an adaptor system for use between an antenna plug (31) and a socket (13) of said portable unit, said portable unit comprising a housing (14) containing said socket (13) and arranged for receiving an adaptor member (10), said adaptor member comprising an electrical connection and mechanical coupling (11) located at one end thereof adapted to cooperate with said antenna plug (31), electrical connection means located at the other end thereof adapted to cooperate with said socket (13) and coming into electrical contact with said socket purely by axial insertion of said adaptor member (10) into said housing, and locking means (26), on said, adaptor member (10), cooperating with manually operable holding means (23) associated with sssaid housing (14) for retaining said adaptor member (10) in said housing (14) and in contact with said socket (13) to provide an electrical path between said antenna plug (31) cooperates with said electrical connection and mechanical coupling (11), said holding means (23) comprising manually operated releasing means (24, 25, 27), operable from an exterior side of said housing (14), for easily and rapidly releasing the retained adaptor member (10) from said housing.

* * * * *